US008555735B2

(12) United States Patent
Nawa et al.

(10) Patent No.: US 8,555,735 B2
(45) Date of Patent: Oct. 15, 2013

(54) STARTER FOR VEHICLE

(75) Inventors: Yukio Nawa, Gifu (JP); Youichi Hasegawa, Kasugai (JP)

(73) Assignee: Denso Corporation, Kariya (JP)

( * ) Notice: Subject to any disclaimer, the term of this patent is extended or adjusted under 35 U.S.C. 154(b) by 11 days.

(21) Appl. No.: 13/447,724

(22) Filed: Apr. 16, 2012

(65) Prior Publication Data

US 2012/0260770 A1 Oct. 18, 2012

(30) Foreign Application Priority Data

Apr. 15, 2011 (JP) ..... 2011-091235

(51) Int. Cl.
*F02N 15/02* (2006.01)
*F02N 15/06* (2006.01)
*F02N 15/00* (2006.01)

(52) U.S. Cl.
USPC ..... 74/7 C; 74/7 A; 74/7 E

(58) Field of Classification Search
USPC ..... 74/6, 7 A, 7 E, 7 C, 7 R
See application file for complete search history.

(56) References Cited

U.S. PATENT DOCUMENTS

| | | | | |
|---|---|---|---|---|
| 5,126,583 | A * | 6/1992 | Isozumi et al. | 290/48 |
| 8,143,979 | B2 * | 3/2012 | Usami et al. | 335/131 |
| 8,289,110 | B2 * | 10/2012 | Niimi et al. | 335/126 |
| 8,299,639 | B2 * | 10/2012 | Usami et al. | 290/38 R |
| 8,421,562 | B2 * | 4/2013 | Murata et al. | 335/126 |
| 2009/0183595 | A1 | 7/2009 | Niimi | |
| 2013/0025407 | A1 * | 1/2013 | Niimi | 74/7 E |

FOREIGN PATENT DOCUMENTS

| | | |
|---|---|---|
| JP | B2-4207854 | 1/2009 |
| JP | A-2009-191843 | 8/2009 |

* cited by examiner

*Primary Examiner* — Justin Krause
(74) *Attorney, Agent, or Firm* — Oliff & Berridge, PLC

(57) ABSTRACT

The starter includes an electromagnetic switch includes a first solenoid for pushing out the pinion shaft to an engine side and a second solenoid for opening and closing a main contact through which a current is supplied to a motor. The first and second solenoids are disposed coaxially with the pinion shaft. The first and second plungers included in the first and second solenoids, respectively are disposed overlapping with each other in the axial direction of the starter such that a rear portion of the first plunger enters inside the second plunger when they are deenergized.

3 Claims, 5 Drawing Sheets

STARTER FOR VEHICLE

This application claims priority to Japanese Patent Application No. 2011-91235 filed on Apr. 15, 2011, the entire contents of which are hereby incorporated by reference.

BACKGROUND OF THE INVENTION

1. Field of the Invention

The present invention relates to a starter for a vehicle.

2. Description of Related Art

Japanese Patent Application Laid-open No. 2009-191843 filed by the applicant of the present application describes a starter which can be advantageously used for an idle stop apparatus. This starter is provided with an electromagnetic switch of the tandem solenoid type including a first solenoid for pushing out a pinion of the starter toward a ring gear of an engine through a shift lever, and a second solenoid for interrupting a current supplied to a motor by opening and closing a main contact, the first and second solenoids being disposed in tandem in the axial direction of the starter. Since the first and second solenoids can be controlled independently from each other, that is, since the timing to push out the pinion and the timing to supply a current to the motor can be controlled independently from each other, this starter can be used advantageously for an idle stop control apparatus.

The idle stop control apparatus is an apparatus which enables automatically stopping an engine of a vehicle by cutting supply of fuel to the engine when the vehicle is stopped at an intersection on a red light, or stopped due to traffic jam, and automatically restarting the engine by causing the starter to operate when a predetermined restart condition is met (for example, when the vehicle driver releases the brake pedal, or shifts the transmission to the drive range) thereafter. Vehicles using such an idle stop control apparatus are increasing in number, because it contributes to reduction of emission of carbon dioxide and fuel consumption.

The starter described in the above patent document has a configuration in which a plunger is attracted by a magnetic force (an attraction force of an electromagnet) generated by the first solenoid to push out the pinion through the shift lever coupled to the plunger, the armature shaft of the motor and the pinion shaft being coupled coaxially with each other through an epicyclic gear device.

There is also known a speed reduction type starter in which the armature shaft of a motor and the pinion shaft are disposed in parallel to each other, and the rotation of the armature shaft is transmitted to the pinion shaft through a reduction gear device. For example, refer to Japanese Patent No. 4207854. The speed reduction type starter as described in this patent document is configured to push out the pinion shaft toward an engine in interlock with a plunger included in an electromagnetic switch which is disposed coaxially with the pinion shaft.

However, the electromagnetic switch of the starter as described in the former patent document has a problem in that its axial length is large, because the first and second solenoids are disposed in tandem in the axial direction of the starter. In the speed reduction type starter as described in the latter patent document, the electromagnetic switch is disposed coaxially with the pinion shaft. Accordingly, if the tandem solenoid type electromagnetic switch described in the former patent document is used in the starter as described in the latter document, the axial length of the starter including the pinion shaft further increases, causing it difficult to be mounted on a vehicle.

In addition, due to the long axial length compared to the conventional speed reduction type starter as described in the latter patent document, since the position of an M-contact bolt (a motor-contact bolt) fixed to a resin cover of the electromagnetic switch is shifted greatly in the axial direction, workability of connection of a motor lead drawn from the motor to the M-contact bolt may become worse.

SUMMARY

An exemplary embodiment provides a starter comprising:

a motor for generating a driving torque;

a pinion shaft disposed in parallel with an armature shaft of the motor;

a pinion supported by the pinion shaft to rotate together with the pinion shaft;

a reduction gear device for reducing rotational speed of the motor and increasing the driving torque;

a clutch for transmitting the driving torque increased by the reduction gear device to the pinion shaft; and an electromagnetic switch including a first solenoid for pushing out the pinion shaft to an engine side using magnetic force generated by a first coil, and a second solenoid for opening an closing a main contact through which a current is supplied to the motor in accordance with energization/deenergization of a second coil, the first and second solenoids being disposed coaxially with the pinion shaft, the starter being configured to transmit the driving torque transmitted to the pinion shaft to a ring gear of an engine to crank the engine, wherein, when a side of the pinion in an axial direction of the starter is referred to as a front end side, and a side opposite to the pinion in the axial direction is referred to as a rear end side, the first solenoid and the second solenoid share a magnetic plate having an annular shape and disposed between the first and second coils so as to be orthogonal to an axial center direction of the first and second coils, the first coil is disposed on the front end side with respect to the magnetic plate, the second coil is disposed on the rear end side with respect to the magnetic plate, the first solenoid includes a first plunger for pushing out the pinion shaft toward the engine side by being attracted by magnetic force generated by the first coil, and the first plunger is formed with a step portion at a radially outer periphery thereof, wherein, when a portion of the first plunger on the front end side with respect to the step portion is referred to as a plunger slide portion, and a portion of the first plunger on the rear end side with respect to the step portion is referred to as a plunger rear portion, an outer diameter of the plunger rear portion is smaller than an outer diameter of the plunger slide portion, the second solenoid includes a second plunger which moves in a direction to close the main contact by being attracted by magnetic force generated by the second coil, the second plunger has a shape of a cylinder which opens to the front end side, an inner diameter of the cylinder being larger than the outer diameter of the plunger rear portion, and the first and second plungers are disposed overlapping with each other in the axial direction such that the plunger rear portion enters inside the second plunger when the first and second coils are deenergized.

According to the exemplary embodiment, it is possible to reduce the length of an electromagnetic switch of the tandem solenoid type which is disposed coaxially with a pinion shaft of a starter.

Other advantages and features of the invention will become apparent from the following description including the drawings and claims.

PREFERRED EMBODIMENTS OF THE INVENTION

First Embodiment

Figure 1:
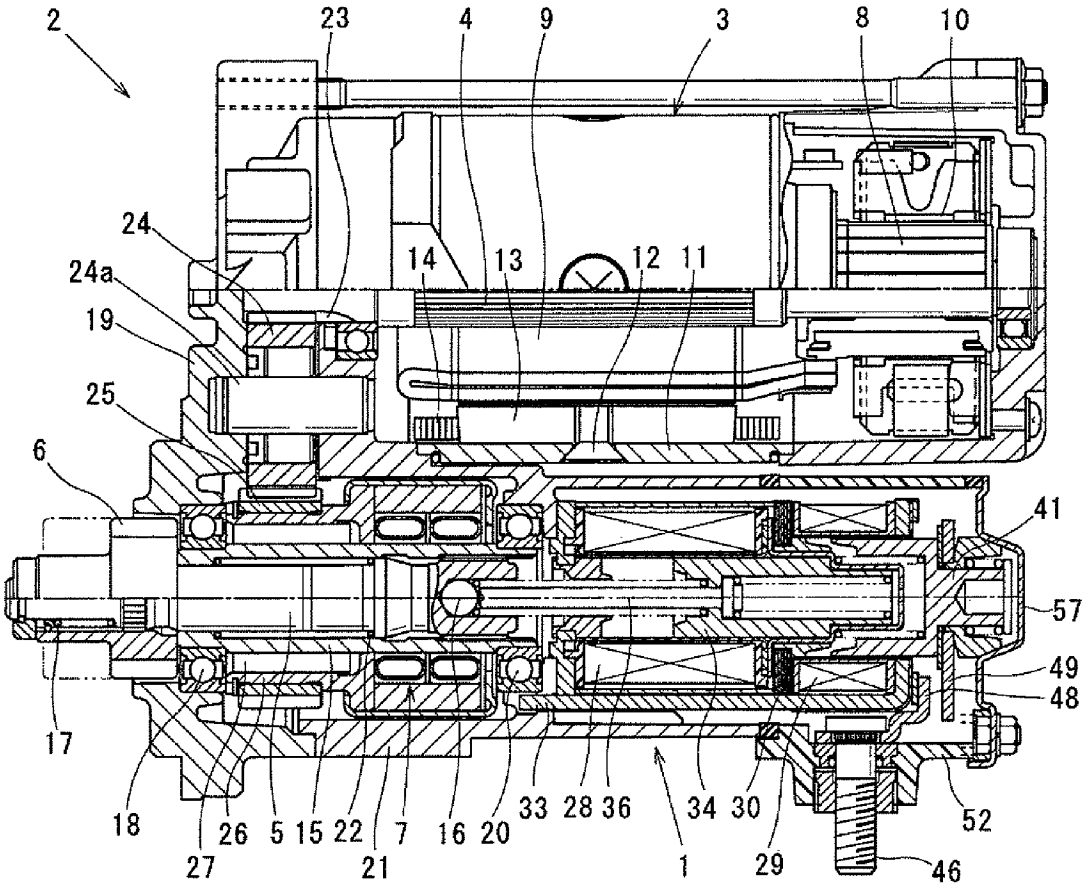
FIG. 1 is a cross-sectional view of a starter according to a first embodiment of the invention.

As shown in FIG. 1, a speed reduction type starter 2 as a first embodiment of the invention includes a motor 3 for generating torque, a pinion shaft 5 disposed in parallel to an armature shaft 4 of the motor 3, a pinion 6 fixed to the outer periphery of the pinion shaft 5 to rotate together with pinion shaft 5, a reduction gear device (explained later) for reducing the rotational speed of the motor 3 and increasing the torque of the motor 3, a clutch 7 for transmitting the torque increased by the reduction gear device to the pinion shaft 5, and an electromagnetic switch 1 disposed coaxially with the pinion shaft 5.

The motor 3 is a commutator motor including a magnetic field device (explained later) for generating a magnetic field, an armature 9 having a commutator 8 disposed on the armature shaft 4, and brushes 10. In this embodiment, the magnetic field device of the motor 3 is a coil-type field device including magnetic field poles 13 fixed to the inner periphery of a yoke constituting a magnetic circuit by screws 12, and a flat wire 14 as a field coil wound around the magnetic poles 13. Alternatively, the magnetic field device may be a magnet-type field device in which permanent magnets are disposed on the inner periphery of the yoke 11.

The pinion shaft 5 is inserted into and helical spline-connected to the spline tube 15 so as to be movable in the axial direction of the starter (in the left-right direction in FIG. 1). The pinion shaft 5 is formed with a perforated hole at an axial center portion of its rear end surface on the opposite-engine side (on the right side in FIG. 1). A steel ball 16 is disposed in this perforated hole. The pinion 6 is vertical spline-fitted to the outer periphery of the pinion shaft 5 projecting from the front end surface (the left end surface in FIG. 1) of the spline tube 15, and pressed against the front end surface of the spline tube 15 by a pinion spring 17. The spline tube 15 is rotatably supported by a starter housing 19 through a ball bearing 18 at its end surface on the pinion side, and rotatably supported by a center case 21 through a ball bearing 20 at its end surface on the opposite pinion side. A return spring 22 for biasing the pinion shaft 5 toward the opposite engine side with respect to the spline tube 15 is disposed inside the spline tube 15.

The reduction gear device is constituted of a gear train including a drive gear 24 formed in the end portion of the armature shaft 4, an idle gear 24 meshed with the drive gear 23 and a clutch gear 25 meshed with the idle gear 24. The idle gear 24 is rotatably supported by a gear shaft 24*a* pressure-inserted into the center case 21 at its one end portion. The clutch gear 25 is fitted to the outer periphery of a gear boss section 26 having a cylindrical shape and rotatably supported by the outer periphery of the spline tube 15 through a bearing 27. The clutch 7 includes a clutch outer to which rotation of the clutch gear 25 is transmitted through the gear boss section 26, a clutch inner formed integrally with the spline tube 15, and clutch rollers for transmitting rotation of the clutch outer to the clutch inner. The clutch 7 is a one-way clutch capable of transmitting torque from the clutch outer to the clutch inner through the clutch rollers, and interrupting transmission of power from the clutch inner to the clutch outer.

Next, the structure of the electromagnetic switch 1 is explained with reference to FIGS. 2 to 4. In the following, the pinion side (the left side in FIG. 2) in the axial direction is referred to as a front end side, and the opposite pinion side (the right side in FIG. 2) is referred to as a rear end side. The electromagnetic switch 1 includes a first coil (referred to as the SL1 coil 28 hereinafter) for generating a magnetic force when energized, a first solenoid (referred to as the solenoid SL1) for pushing out the pinion shaft 5 toward the engine side using the magnetic force generated by the SL1 coil 28), a second coil (referred to as the SL2 coil 29 hereinafter) for generating a magnetic force when energized, and a second solenoid (referred to as the solenoid SL2) for opening and closing a main contact (to be explained later) in accordance with energization and deenergization of the SL2 coil 29. The solenoid SL1 and the solenoid SL2 are disposed in tandem along the axial direction.

The solenoid SL1 and the solenoid SL2 share a magnetic plate 30 disposed between the SL1 coil 28 and the SL2 coil 29 so as to extend in the direction orthogonal to the axial center direction of these coils 28 and 29. The SL1 coil 28 is disposed on the front end side, and the SL2 coil 29 is disposed on the rear end side with respect to the magnetic plate 30. As shown in FIG. 4, these coils 28 and 29 are connected to current supply terminals 31 and 32, respectively at their one coil ends, and grounded at their other coil ends. In this embodiment, the magnetic plate 30 is formed by laminating a plurality of core sheets formed by pressing a thin steel plate into annular rings. A core stationary 33 having a cylindrical shape is disposed around the outer periphery of the magnetic plate 30 so as to form a magnetic yoke radially outside the SL1 coil 28 and the SL2 coil 29.

The solenoid SL1 includes a first plunger (referred to as the SL1 plunger 34 hereinafter) which moves the pinion shaft 5 toward the engine side (toward the left side in FIG. 2) when attracted by the SL1 coil 20 serving as an electromagnet, a first fixed core (referred to as the SL1 fixed core 35 hereinafter) for attracting the SL1 plunger 34, a plunger shaft 36 for transmitting movement of the SL1 plunger 34 to the plunger shaft 5, a return spring 37 for pushing back the SL1 plunger 34 when the attraction force of the electromagnet disappears, and a drive spring 39 for storing reaction force to pushing the pinion 6 into a ring gear 38 (see FIG. 4) of the engine.

Figure 2:
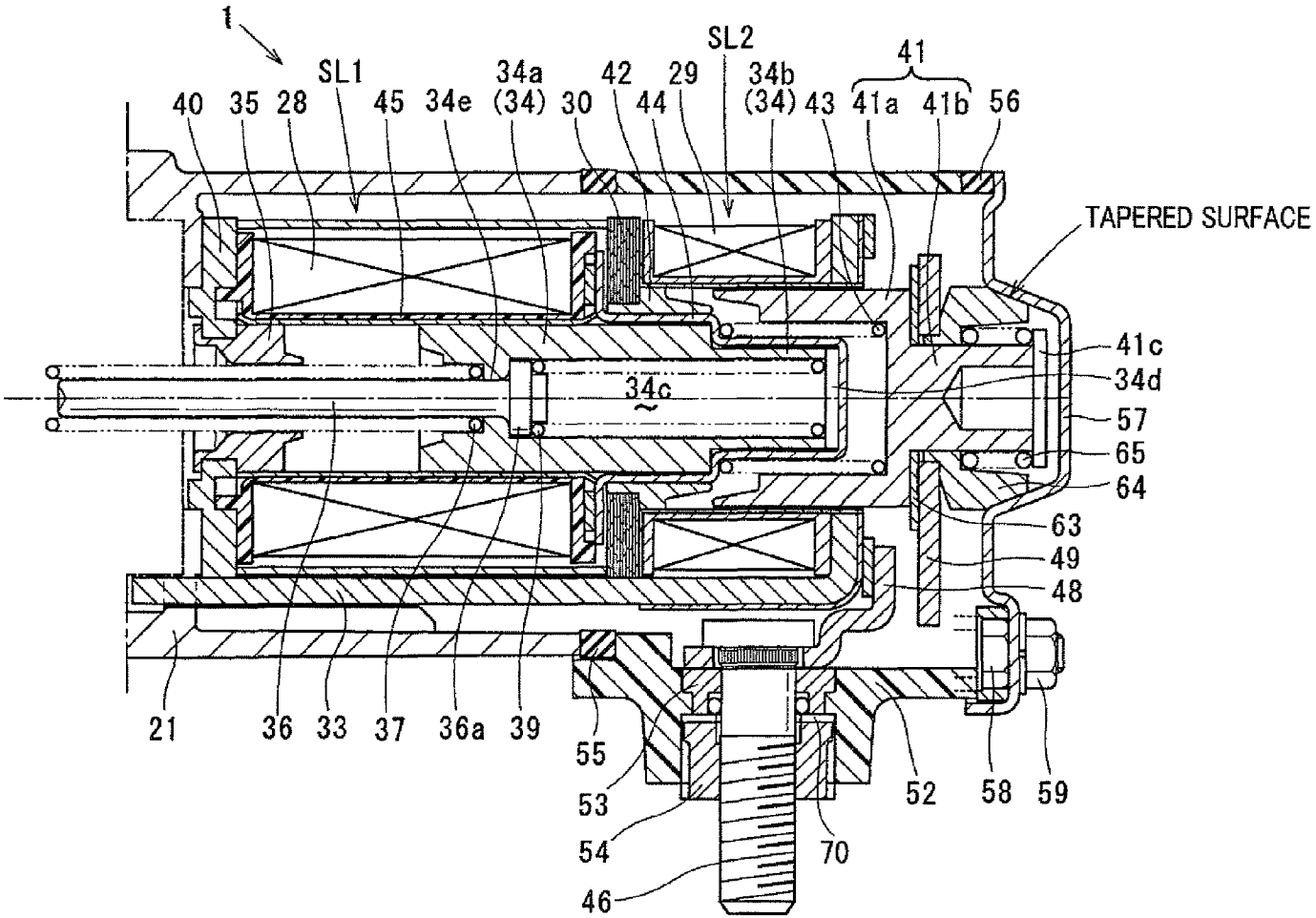
FIG. 2 is an enlarged cross-sectional view of an electromagnetic switch included in the starter shown in FIG. 1.

The SL1 plunger 34 is formed with a hollow hole 34*c* penetrating through its center portion in the longitudinal direction (in the left-right direction in FIG. 2). The hollow hole 34*c* is closed at its rear end by an end plate 34*d*. The hollow hole 34*c* is formed with a narrow opening portion having a reduced diameter at its front end side. The SL1 fixed core 35 is disposed inside the SL1 coil 28 so as to face the SL1 plunger 34 at the front end side in the axial direction. The SL1 fixed core 35 is coupled to the core stationary 33 through a core plate 40 to form a magnetic path.

The plunger shaft 36 penetrates through the narrow opening portion 34*e* and assembled to the SL1 plunger 34. The frond end portion of the plunger shaft 36 projecting from the front end of the SL1 plunger 34 at which the hollow hole 34*c* opens penetrates through the SL1 fixed core 35, and is inserted into the perforated hole formed in the rear end surface of the pinion shaft 5. The plunger shaft 36 is formed with a flange portion 36*a* having a diameter larger than the inner diameter of the narrow opening portion 34*e* at its rear end.

The return spring 37 is disposed around the periphery of the plunger shaft 36, and supported by the steel ball 16 at its front end and by the edge of the narrow opening portion 34*e* of the SL1 plunger at its rear end. The drive spring 39 is accommodated in the hollow hole 34*c* formed in a portion of the SL1 plunger 34, which is closer to the rear end than the narrow opening portion 34*e*, and supported by the flange portion 36*a* of the plunger shaft 36 at its front end, and by the end plate 34*d* closing the rear end of the hollow hole 34*c* at its rear end.

The solenoid SL2 includes a second plunger (referred to as the SL2 plunger 41 hereinafter) which moves in the direction to close the main contact (toward the left side in FIG. 2) when attracted by the SL2 coil 29 serving as an electromagnet, a second fixed core (referred to as the SL2 fixed core 42 hereinafter) for attracting the SL2 plunger 41, and a return spring 43 for pushing back the SL2 plunger 41 when the attraction force of the electromagnet disappears. The SL2 plunger 41 includes a plunger slide portion 41*a* having a shape of a cylinder which opens at its front end, and a plunger small diameter portion 41*b* having a reduced diameter and located in the back of the plunger slide portion 41*a*. A flange plate 41*c* having a diameter slightly larger than the plunger small diameter portion 41*b* is provided in the rear end of the plunger small diameter portion 41*b*.

The SL2 fixed core 42 is disposed inside the SL2 coil 29 so as to face the SL2 plunger 41 at the axially front side, and fixed to the inner periphery of the magnetic plate 30. The return spring 43 is disposed between a partition wall plate 44 for regulating a return position of the SL1 plunger 34 and the inner bottom of the plunger slide portion 41*a*. The return position of the SL1 plunger 34 is a position at which the SL1 plunger 34 being pushed back by the return spring 43 rests by being regulated by a step surface of the partition wall plate 44 when the attraction force of the solenoid SL1 disappears. The partition wall plate 44 is made of a non-magnetic metal such as aluminum, brass or stainless steel. The partition wall plate 44 has a shape of a cup which covers the rear end portion of the SL1 plunger 34 and is bent radially outward at its open end to be held between a bobbin 45 of the SL1 coil 28 and the magnetic plate 30.

Figure 4:
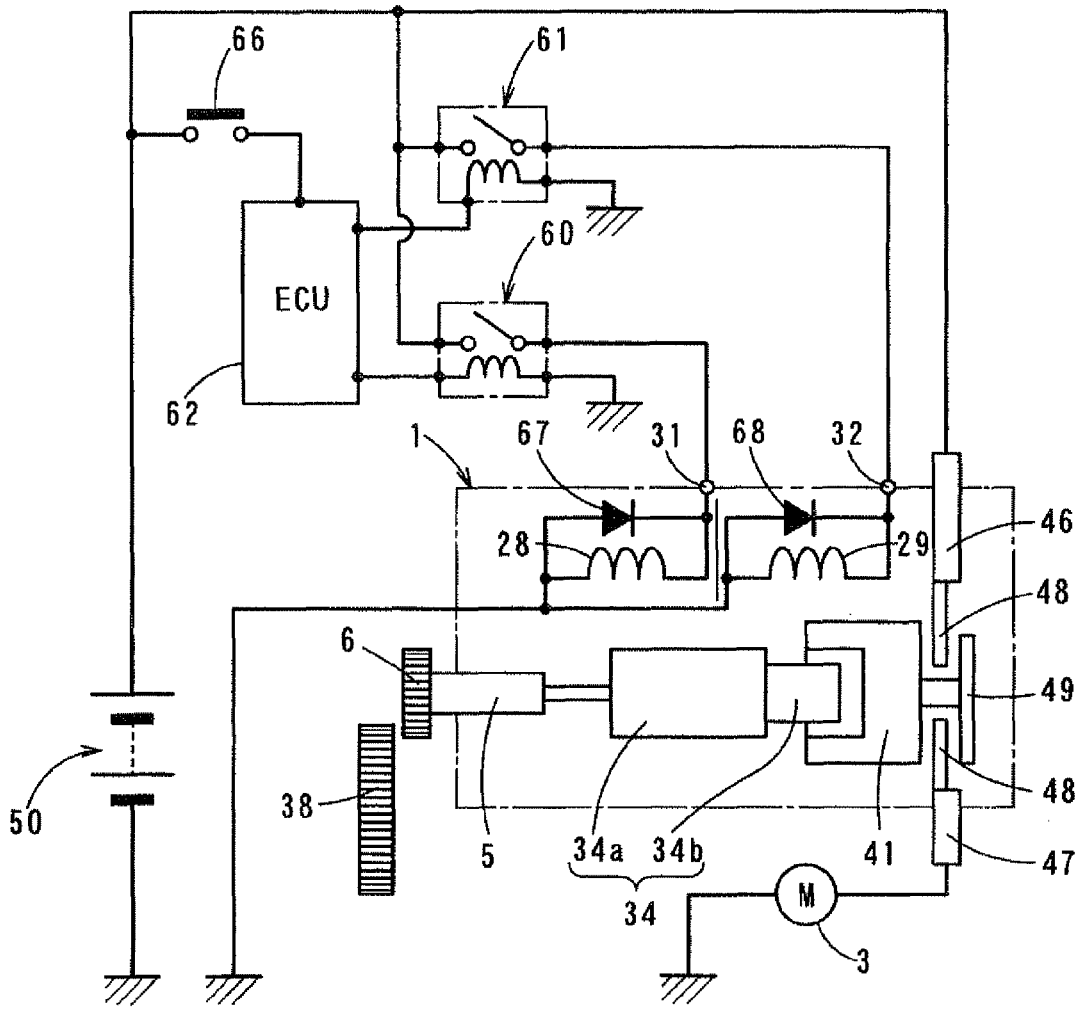
FIG. 4 is an electrical circuit diagram of the starter shown in FIG. 1.

As shown in FIG. 4, the main contact is constituted of a pair of fixed contacts 48 connected to a current supply circuit of the motor 3 through contact bolts 46 and 47, respectively, and a movable contact 49 for making and breaking electrical connection between the fixed contacts 48. When the movable contact 49 is in contact with the fixed contacts 49 to make electrical continuity between them, the main contact is closed (turned on). When the movable contact 49 is out of contact with the fixed contacts 49 to break electrical continuity between them, the main contact is opened (turned off). The current supply circuit of the motor 3 is an electric circuit for passing a current from a battery 50 (see FIG. 4) to the motor 3 when the main contact is closed.

Figure 3:
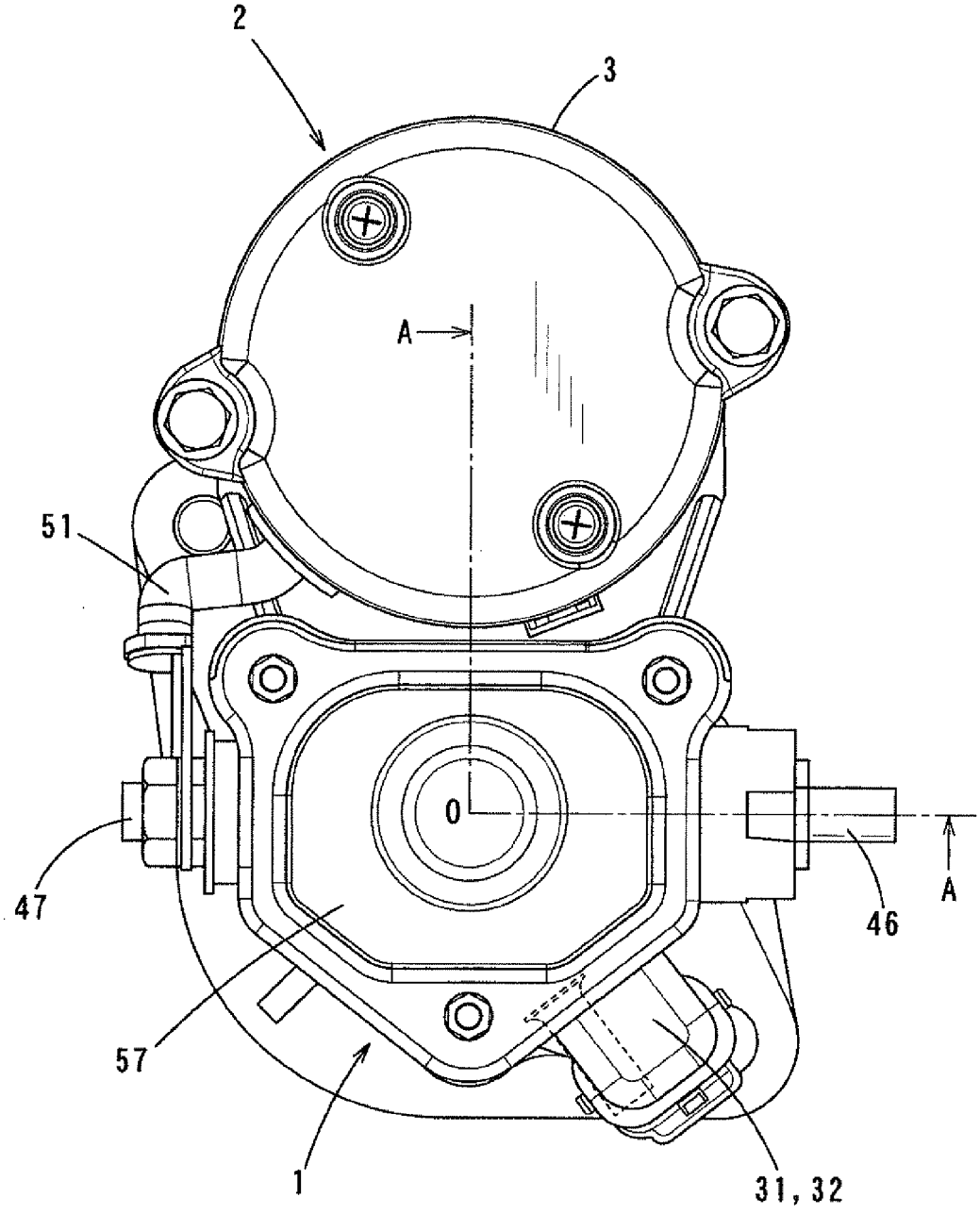
FIG. 3 is a plan view of the starter shown in FIG. 1 as viewed from the rear side in the axial direction of the starter.

As shown in FIG. 3, the contact bolt 46 is a B-contact bolt to which a battery cable (not shown) is connected, and the contact bolt 47 is an M-contact bolt to which a motor lead 51 is connected. As shown in FIG. 2, each of the contact bolts 46 and 47 is fixed to a resin frame 52 by tightening a nut 54 to a male thread portion of a collar 53 embedded in the resin frame 52 through a washer 70. Incidentally, although the B-contact bolt 46 is shown as being drawn downward from the resin frame 52 in FIG. 2, actually, the two contact bolts 46 and 47 are drawn from the left and right sides of the resin frame 52, respectively. That is, FIG. 1 is a cross-sectional view of FIG. 3 taken along line A-O-A.

As shown in FIG. 2, the resin frame 52 is assembled to the rear end of the center case 21 through a sealing member 55 so as to cover the rear end side of this electromagnetic switch 1 (mainly the outer periphery of the solenoid SL2). An end cover 57 made of metal is fixed to the resin frame 52 through a sealing member 56 by tightening a lower nut 58 and an upper nut 59 to a bolt (not shown) insert-fixed to the resin frame 52 so as to cover the rear end of the resin frame 52. The resin frame 52 is fitted with the current supply terminals 31 and 32. As shown in FIG. 4, the current supply terminals 31 and 32 are connected with a power supply cable connected to the battery 50 through an SL1-use relay 60 and an SL2-use relay 61, respectively. The SL1-use relay 60 and the SL2-use relay 61 are on/off-controlled by a later-explained ECU 62 (see FIG. 4).

The two fixed contacts 48 are provided separately from the two contact bolts 46 and 47, respectively. They may be fixed by pressure-inserting the underhead portions of the contact bolts 46 and 47 into circular holes respectively formed in the fixed contacts 48. The contact bolts 46 and 47 may be formed with serrations at their underhead portions, so that the fixed contacts 48 can be fixed by pressure-inserting the underhead portions formed with the serrations into circular holes formed in the fixed contacts 48. The material of the contact bolts 46 and 47 may be different from the material of the fixed contacts 48. For example, the fixed contacts 48 may be made of copper material having high electrical conductivity, and the contact bolts 46 and 47 may be made of steel material having high mechanical strength. When the contact bolts 46 and 47 are made of steel material, their surfaces may be copper-plated, so that they have high electrical conductivity in addition to high mechanical strength.

As shown in FIG. 2, the movable contact 49 is biased toward a shoulder surface of the plunger slide portion 41 by a contact-pressure spring 65 for providing a contact pressure when the main contact is closed, the contact-pressure spring 65 being interposed between an insulating plate 63 and an insulating brush 64 and held by the outer peripheral of a plunger small diameter portion 41*b* formed in the rear end of the SL2 plunger 41. The contact-pressure spring 65 is supported by the insulating bush 64 at its front end, and by the flange plate 41*c* attached to the rear end of the plunger small diameter portion 41*b*. The return position of the SL2 plunger 41, that is, the position at which the SL2 plunger 41 being pushed back by the return spring 43 rests when current supply to the SL2 coil 29 is stopped and the attraction force of the electromagnet disappears, is regulated by abutment of a tapered surface of the insulating bush 64 against a tapered surface of the end cover 57.

Next, the SL1 plunger 34 and the SL2 plunger 41 are explained in detail. The SL1 plunger 34 is formed with a step portion at its outer peripheral. When a portion of the SL1 plunger 34 on the front end side with respect to this step portion is referred to as a plunger slide portion 34*a*, and a portion on the rear end side with respect to this step portion is referred to as a plunger rear portion 34*b*, the outer diameter of the plunger rear portion 34*b* is made smaller than the outer diameter of the plunger slide portion 34*a*. On the other hand, the inner diameter of the plunger slide portion 41*a* of the SL2 plunger 41 is made larger than the outer diameter of the plunger rear portion 34*b*. In this embodiment, the inner diameter of the plunger slide portion 41*a* and the outer diameter of the plunger slide portion 34*a* are made approximately equal to each other. As shown in FIG. 2, the SL1 plunger 34 and the SL2 plunger 41 are overlapped with each other in the axial direction such that the plunger rear portion 34*b* enters inside the SL2 plunger 41 when both the SL1 coil 28 and the SL2 coil 29 are deenergized, that is, when both the SL1 plunger 34 and the SL2 plunger 41 rest at their return positions.

Further, when the SL1 coil 28 is deenergized, the rear end of the plunger slide portion 34*a* enters inside the SL2 fixed core 42. That is, the SL1 plunger 34 is disposed such that the plunger slide portion 34*a* overlaps with the SL2 fixed core 42 in the axial direction at its rear end side. More specifically, as shown in FIG. 2, the return position (rest position) of the SL1 plunger 34 is set such that the rear end surface of the SL2 fixed core 42 opposite to the SL2 plunger 41 in the axial direction and the rear end of the plunger slide portion 34*a* (that is, the step portion formed in the outer periphery of the SL1 plunger 34) are at approximately the same position.

Next, the operation of the speed reduction type starter 2 having the above described structure is explained. In this embodiment, the electromagnetic switch 1 enables the ECU 62 to control the solenoid SL1 and the solenoid SL2 independently. The ECU 62, which is an electronic control unit for use in an idle stop control system configured to start operation when a key switch 66 is turned on, receives an engine rotational signal, a transmission lever position signal, a brake on/off signal and so forth through an engine ECU (not shown) for controlling the engine, and transmits an engine stop signal to the engine ECU upon determining that a predetermined engine stop condition is met based on these received signals. The ECU 62 determines that an engine restart request has occurred when the vehicle driver performs an operation to start the vehicle such as releasing of the brake pedal or shifting the transmission to the drive range, and transmits an engine restart request signal to the engine ECU while transmitting an ON signal to the SL1-use relay 60 and the SL2-use relay 61.

Next, an operation of the speed reduction type starter 2 during an engine stop period (during a deceleration period in which the rotational speed of the engine decreases until it completely stops) is explained as an example of idle stop operation. The ECU 62 outputs an ON signal to the SL1-use relay 60 when an engine restart request signal has occurred during the engine stop period. As a result, the SL1-use relay 60 is turned on, a current is supplied from the battery to the communication terminal 31 through the SL1-use relay 60, and the SL1 coil 28 connected to the communication terminal 31 is energized.

When the SL1 coil 28 is energized and starts serving as an electromagnet, the SL1 plunger 34 is attracted by, and moves to the SL1 fixed core 35 magnetized by this electromagnet. By the movement of the SL1 plunger 34, the pinion shaft 5 is pushed out toward the engine side through the plunger shaft 36 and the steel ball 16, as a result of which the side of the pinion 6 supported by the pinion shaft 5 abuts against the side of the ring gear 38. At this time, the engine is not completely stopped. That is, since the ring gear 38 of the engine rotates while decelerating, when the ring gear 38 rotates to a position at which the ring gear 38 can mesh with the pinion 6, the pinion 6 is pushed out by the reaction force stored in the drive spring 39.

The ECU 62 outputs an ON signal to the solenoid SL2 at a timing later than the timing at which an ON signal to turn on the SL1-use relay 60 was outputted to the solenoid SL1 by a predetermined time (30 to 40 ms, for example). As a result, the SL2-use relay 61 is turned on, a current is supplied from the battery 50 to the communication terminal 32 through the SL2-use relay 61, and the SL2 coil 29 connected to the communication terminal 32 is energized. When the SL1 coil 29 is energized and starts serving as an electromagnet, the SL2 plunger 41 is attracted by, and moves to the SL2 fixed core 42 magnetized by this electromagnet. By the movement of the SL2 plunger 41, the movable contact 49 abuts against the pair of the fixed contacts 48 to close the main contact. As a result, a current is supplied to the motor 3 from the battery 50, and torque is generated in the armature 9. This torque is increased by the reduction gear device, and transmitted to the pinion shaft 5 through the clutch 7. At this time, since the pinion 6 is already engaged with the ring gear 38, and accordingly the torque of the motor 3 is transmitted from the pinion 6 to the ring gear 38, the engine can be cranked quickly.

As shown in FIG. 4, the SL1 coil 28 and the SL2 coil 29 are parallel-connected with a diode 67 and a diode 68, respectively for suppressing back electromotive forces respectively induced in the SL1 coil 28 and the SL2 coil 29 when the SL1-use relay and the SL2-use relay are turned off. In the above explanation, the solenoid SL1 is energized earlier than the solenoid SL2. However, the order may be reversed. That is, the above embodiment may be modified such that after the main contact is closed by energizing the solenoid SL2 to supply a current to the motor 3, the pinion shaft 5 is pushed out by energizing the solenoid SL1 while equalizing the rotational speed of the pinion 6 to the rotational speed of the ring gear 38 to cause the pinion 6 to engage with the ring gear 38.

The first embodiment described above provides the following advantages. As shown in FIG. 2, when the SL1 coil 28 and the SL2 coil 29 are not energized, that is when the SL1 plunger 34 and the SL2 plunger 41 are stationary, the plunger rear portion 34*b* of the SL1 plunger 34 enters inside the plunger slide portion 41*a* so that the SL1 plunger 34 partially overlaps with the SL2 plunger 41 in the axial direction. Accordingly, according to this embodiment, it is possible to reduce the axial length of the electromagnetic switch 1 of the tandem solenoid type in which the solenoid SL1 and the solenoid SL2 are disposed in tandem in the axial direction.

In the speed reduction type starter 2, since the electromagnetic switch 1 disposed coaxially with the pinion shaft 5 is pushed out toward the engine side, the plunger stroke (the distance of movement of the SL1 plunger 34) is large compared with the lever type starter as described in the foregoing patent document 1. Hence, the advantage that the axial length of the electromagnetic switch can be reduced is significant in vehicle mountability particularly in the case of the tandem solenoid type electromagnetic switch. In addition, since it is not necessary to shift the position of the M-contact bolt 47 greatly in the axial direction compared with the conventional speed reduction type starter as described in the foregoing patent document 2, workability of connection of the motor lead 51 (see FIG. 3) to the M-contact bolt 47 can be improved.

In the above embodiment, the solenoid SL1 is energized earlier than the solenoid SL2. However, the solenoid SL2 may be energized earlier than the solenoid SL1. This is because, in the case where the solenoid SL2 is energized when the SL1 plunger 34 is stationary, it is possible to use the rear end portion of the plunger slide portion 34*a* entering inside the SL2 fixed core 42 as a magnetic circuit of the solenoid SL2. In this case, since the magnetic flux density can be reduced to thereby prevent magnetic saturation in the magnetic circuit, it is possible to increase the attraction force of the solenoid SL2. In other words, since the wall thickness of the SL2 fixed core 4 can be made small, and accordingly the outer diameter of the solenoid SL2 can be made small, the electromagnetic switch 1 can be made small in size in the radial direction.

Second Embodiment

In the electromagnetic switch 1 of the first embodiment described above, since the rear end side of the plunger slide portion 34*a* enters inside the SL2 fixed core 42, if the solenoid SL2 is energized earlier than the solenoid SL1, the SL1 plunger 34 is held by the attraction force of the solenoid SL2, that is, by the magnetic force generated by the SL2 coil 29. Since this force to hold the SL1 plunger 34 becomes a load at the time of energizing the solenoid SL1, it is necessary to properly set the attraction force of the solenoid SL1 to attract the SL1 plunger 34 smoothly.

Incidentally, to attract the SL1 plunger 34, the attraction force of the solenoid SL1 has to exceed a necessary load (a spring load shown by the solid line A in the graph of FIG. 5) for compressing the respective springs (the drive spring 39, the return spring 37, and the pinion spring 17). However, in the case where the solenoid SL1 is energized in the state where the SL1 plunger 34 is attracted by the solenoid SL2, it may occur that the attraction force of the solenoid SL1 is smaller than the necessary load shown by the line A, and the SL1 plunger 34 cannot be attracted.

Figure 5:
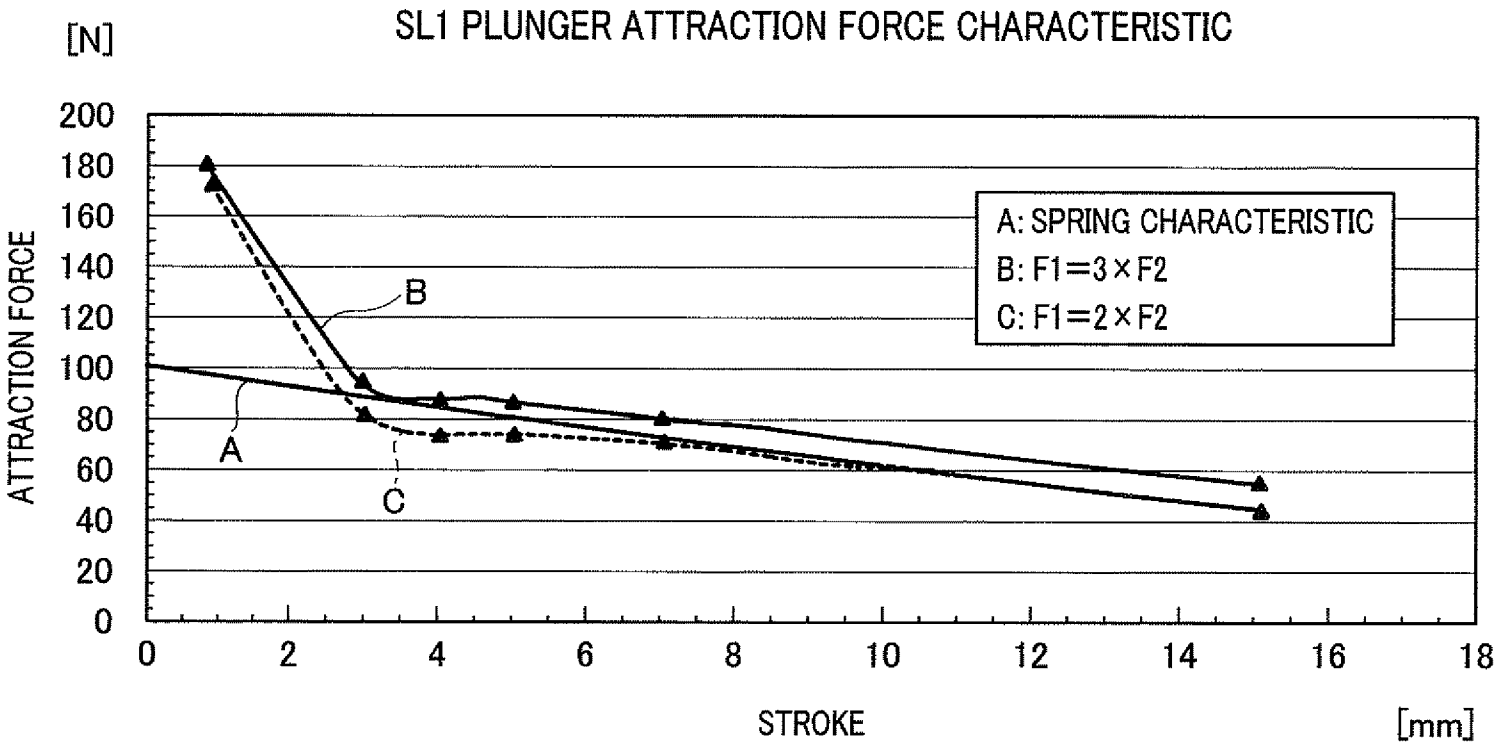
FIG. 5 is a graph showing attraction force characteristics of a first solenoid included in the electromagnetic switch of the starter shown in FIG. 1.

Therefore, the inventors of this invention performed a simulation to obtain the attraction force characteristic of the solenoid SL1 when it is energized by passing a current to the SL1 coil 28 in the state of the solenoid SL2 being energized (the SL2 coil being supplied with a current). FIG. 5 is a graph showing the results of the simulation. In this graph, the vertical axis represents the attraction force of the solenoid SL1, and the horizontal axis represents the movement stroke of the SL1 plunger 34. Each of the solid line B and the broken line C shows calculated values of the attraction force when the SL1 coil 28 is applied with a specified voltage (8 V, for example). The solid line B shows a case where the attraction force F1 of the solenoid SL1 is set equal to three times the attraction force F2 of the solenoid SL2. In this case, since the attraction force F1 of the solenoid SL1 exceeds the spring load shown by the solid line A for the entire stroke of the SL1 plunger 34, it is possible to move the SL1 plunger 34 smoothly even when the SL1 plunger 34 is caught by the attraction force F2 of the solenoid SL2.

The broken line C shows a case where the attraction force F1 of the solenoid SL1 is set smaller than three times (twice, in FIG. 5) the attraction force F2 of the solenoid SL2. In this case, since the attraction force F1 of the solenoid SL1 does not exceed the spring load shown by the solid line A for the entire stroke of the SL1 plunger 34, it is not possible to move the SL1 plunger 34 smoothly. According to this simulation, it is found that, by setting the attraction force F1 of the solenoid SL1 larger than or equal to three times the attraction force F2 of the solenoid SL2, the SL1 plunger 34 can, be moved smoothly against the force to hold the SL1 plunger 34 even when the solenoid SL1 is energized in the state where the solenoid SL2 is energized.

Other than the above, the effect of the attraction force of the solenoid SL2 affecting the SL1 plunger 34 can be reduced by the configuration described below. As shown in FIG. 2, the SL1 plunger 34 enters inside the SL1 coil 28 beyond the front end surface of the magnetic plate 30 at its part ranging more than half the axial length from the rear end surface of the plunger slide portion 34*a* in the axial direction when the SL1 coil 28 is not energized. Accordingly, since the axial length of a section of the plunger slide portion 34*a* used as a magnetic circuit of the solenoid SL1 is longer than that of a section used as a magnetic circuit of the solenoid SL2, the attraction force of the solenoid SL1 can be used more to attract the SL1 plunger 34. In other words, since the rest position of the SL1 plunger is deep inside the SL1 coil 28, and accordingly the effect of the attraction force of the solenoid SL2 affecting the solenoid plunger 34 is reduced, it is possible to move the SL1 plunger 34 smoothly against the force to hold the SL1 plunger 34.

The above explained preferred embodiments are exemplary of the invention of the present application which is described solely by the claims appended below. It should be understood that modifications of the preferred embodiments may be made as would occur to one of skill in the art.

What is claimed is:

1. A starter comprising:

a motor for generating a driving torque;

a pinion shaft disposed in parallel with an armature shaft of the motor;

a pinion supported by the pinion shaft to rotate together with the pinion shaft;

a reduction gear device for reducing rotational speed of the motor and increasing the driving torque;

a clutch for transmitting the driving torque increased by the reduction gear device to the pinion shaft; and an electromagnetic switch including a first solenoid for pushing out the pinion shaft to an engine side using magnetic force generated by a first coil, and a second solenoid for opening and closing a main contact through which a current is supplied to the motor in accordance with energization/deenergization of a second coil, the first and second solenoids being disposed coaxially with the pinion shaft, the starter being configured to transmit the driving torque transmitted to the pinion shaft to a ring gear of an engine to crank the engine, wherein, when a side of the pinion in an axial direction of the starter is referred to as a front end side, and a side opposite to the pinion in the axial direction is referred to as a rear end side, the first solenoid and the second solenoid share a magnetic plate having an annular shape and disposed between the first and second coils so as to be orthogonal to an axial center direction of the first and second coils, the first coil is disposed on the front end side with respect to the magnetic plate, the second coil is disposed on the rear end side with respect to the magnetic plate, the first solenoid includes a first plunger for pushing out the pinion shaft toward the engine side by being attracted by magnetic force generated by the first coil, and the first plunger is formed with a step portion at a radially outer periphery thereof, wherein, when a portion of the first plunger on the front end side with respect to the step portion is referred to as a plunger slide portion, and a portion of the first plunger on the rear end side with respect to the step portion is referred to as a plunger rear portion, an outer diameter of the plunger rear portion is smaller than an outer diameter of the plunger slide portion, the second solenoid includes a second plunger which moves in a direction to close the main contact by being attracted by magnetic force generated by the second coil, the second plunger has a shape of a cylinder which opens to the front end side, an inner diameter of the cylinder being larger than the outer diameter of the plunger rear portion, and the first and second plungers are disposed overlapping with each other in the axial direction such that the plunger rear portion enters inside the second plunger when the first and second coils are deenergized.

2. The starter according to claim 1, wherein the second solenoid is fixed to the magnetic plate so as to be opposite to the second plunger in the axial direction, and includes a fixed core having an annular shape for attracting the second plunger by being magnetized when the second coil is energized, and the plunger slide portion of the first plunger enters inside the fixed core on the rear end side thereof when the first coil is deenergized.

3. The starter according to claim 1, wherein an attraction force of the first solenoid to attract the first plunger is set larger than or equal to three times an attraction force of the second solenoid to attract the second plunger.

* * * * *